US005346362A

United States Patent [19]

Bonner et al.

[11] Patent Number: 5,346,362

[45] Date of Patent: Sep. 13, 1994

[54] MECHANICAL DAMPER

[75] Inventors: Kurt J. Bonner, Maineville, Ohio; Jose M. Alvarez, Jr., Coral Gables, Fla.

[73] Assignee: United Technologies Corporation, Hartford, Conn.

[21] Appl. No.: 52,874

[22] Filed: Apr. 26, 1993

[51] Int. Cl.[5] ..... F01D 9/04

[52] U.S. Cl. ..... 415/191; 415/209.1; 415/119

[58] Field of Search ..... 415/209.1, 209.2, 209.3, 415/209.4, 173.3, 174.4, 174.5, 191, 119; 416/500

[56] References Cited

U.S. PATENT DOCUMENTS

| | | | |
|---|---|---|---|
| 3,326,523 | 6/1967 | Bobo | 415/209.3 |
| 4,314,792 | 2/1982 | Chaplin | 415/175 |
| 4,621,976 | 11/1986 | Marshall et al. | 415/209.1 |
| 4,721,434 | 1/1988 | Marshall et al. | 415/119 |
| 4,897,021 | 1/1990 | Chaplin et al. | 415/174.2 |
| 5,145,316 | 9/1992 | Birch | 415/173.3 X |
| 5,149,250 | 9/1992 | Plemmons et al. | 415/209.2 |
| 5,188,507 | 2/1993 | Sweeney | 415/173.3 X |

*Primary Examiner*—Edward K. Look
*Assistant Examiner*—Michael S. Lee
*Attorney, Agent, or Firm*—Norman Friedland

[57] ABSTRACT

The mechanical damper is fabricated from a relatively thin metal spring stock and formed in cross-section to an E-shape that is arcuately bent into a ring that fits into the cavity defined between the inner diameter of the inner shroud and the outer diameter of the segmented back rings of the honeycomb sealing structure of the stator for the compressor of a gas turbine engine. The E-shaped damper is segmented and provides damping of the compressor stator of a gas turbine engine and is particularly adapted for stators that are formed from integrally cast stator vanes and shrouds.

8 Claims, 3 Drawing Sheets

MECHANICAL DAMPER

TECHNICAL FIELD

This invention relates to mechanical spring-type dampers and particularly to means for damping cast stators used on compressors for gas turbine engines.

BACKGROUND ART

As is well known in the gas turbine engine art, integrally cast stator vanes and shrouds are inherently not capable of providing damping. In the interest of reducing cost in a gas turbine engine, it is desirable to utilize cast parts whenever and wherever practical. The compressor stators and particularly the stators used on the high pressure compressor have proven to be likely candidates where cast parts can be utilized. However, as was mentioned in the above, because cast stator vanes and shrouds inherently do not have damping capabilities in comparison with other similar fabricated designs, the lack of damping has been a major obstacle standing in the way of utilizing cast parts.

As is obvious to one skilled in this art and well known in this industry, damping is essential. Damping is not only necessary to withstand the exceedingly high vibratory stresses incidental in aircraft operation, it must also keep the parts out of resonance to assure their adequate life. It is therefore imperative that damping be incorporated in cast parts in order to attain the desired structural integrity needed in this environment.

Another obstacle that faces the designer of aircraft engine hardware is the limited available space for incorporating dampers. Obviously, commercially available dampers are non-existent and hence unavailable. To this end, this invention contemplates a mechanical spring-like damper that is capable of providing sufficient loading required for damping the vibratory energy existing in this hostile environment and being sufficiently small to be able to fit into the limited space of the available envelope of a high pressure compressor stator of a gas turbine engine.

SUMMARY OF THE INVENTION

An object of this invention is to provide a damper for a cast stator for a gas turbine engine.

A feature of this invention is to provide a spring-like damper that is fabricated from a highly resilient, flexible metallic spring material which is shaped in the form of an "E" in cross section.

Another feature of this invention is to provide an annular E-shaped spring damper (either segmented or continuous) that is sufficiently small to fit into a cavity located on the inside diameter of the shroud of the stator and retained by the honeycomb ring segments circumferentially disposed about the stator.

The foregoing and other features of the present invention will become more apparent from the following description and accompanying drawings.

BEST MODE FOR CARRYING OUT THE INVENTION

While this invention in its preferred embodiment has particular utility for gas turbine engines, as one skilled in this art will appreciate, it has application in rotating machinery in other environments. Suffice it to say that this invention is particularly efficacious for damping vibratory stresses for rotating machinery where there is very little room available to accommodate dampers.

Figure 1:
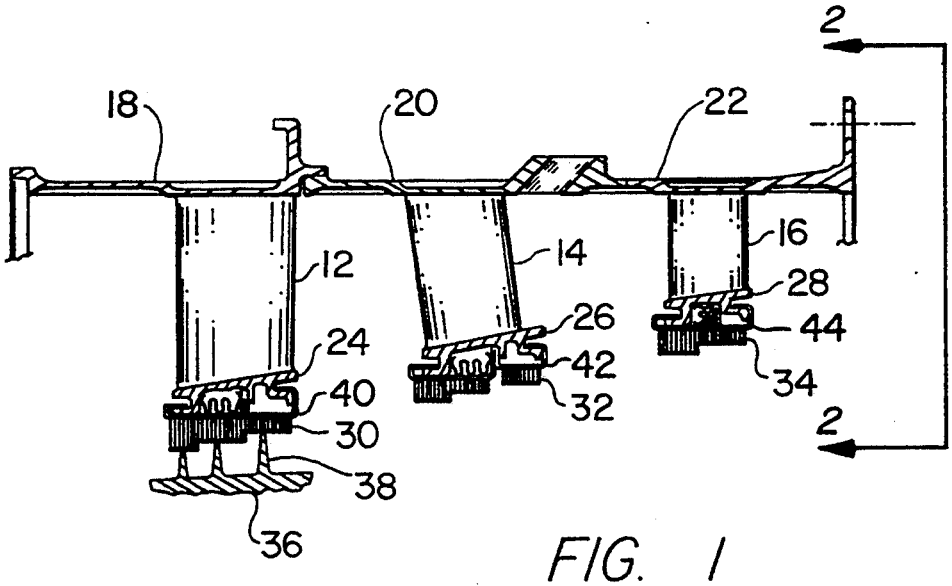
FIG. 1 is a partial view in section illustrating three rows of stator vanes for a compressor of a gas turbine engine incorporating this invention.
Figure 2:
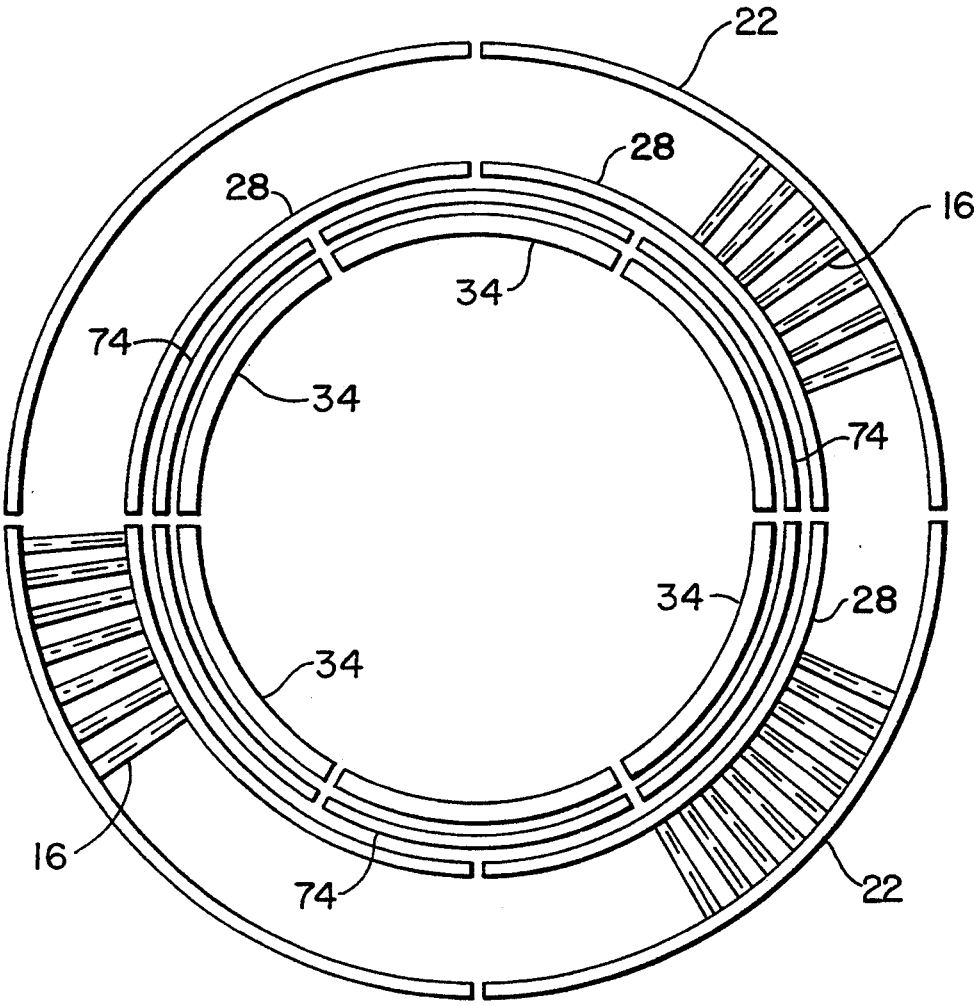
FIG. 2 is a front plan view of the stator vanes depicted in FIG. 1.
Figure 4:
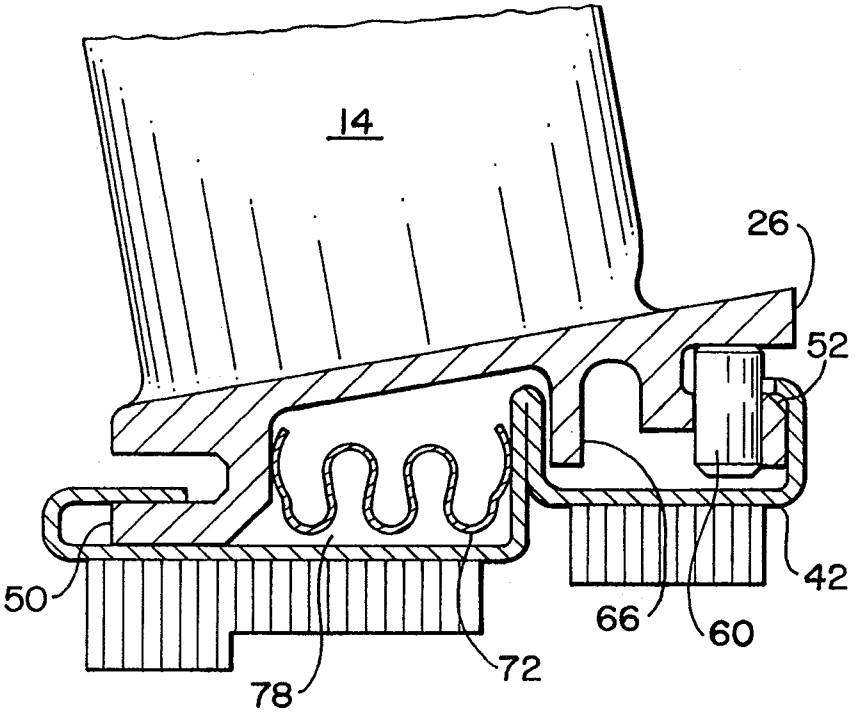
FIG. 4 is an enlarged view in section of another row of stator vanes incorporating this invention.
Figure 3:
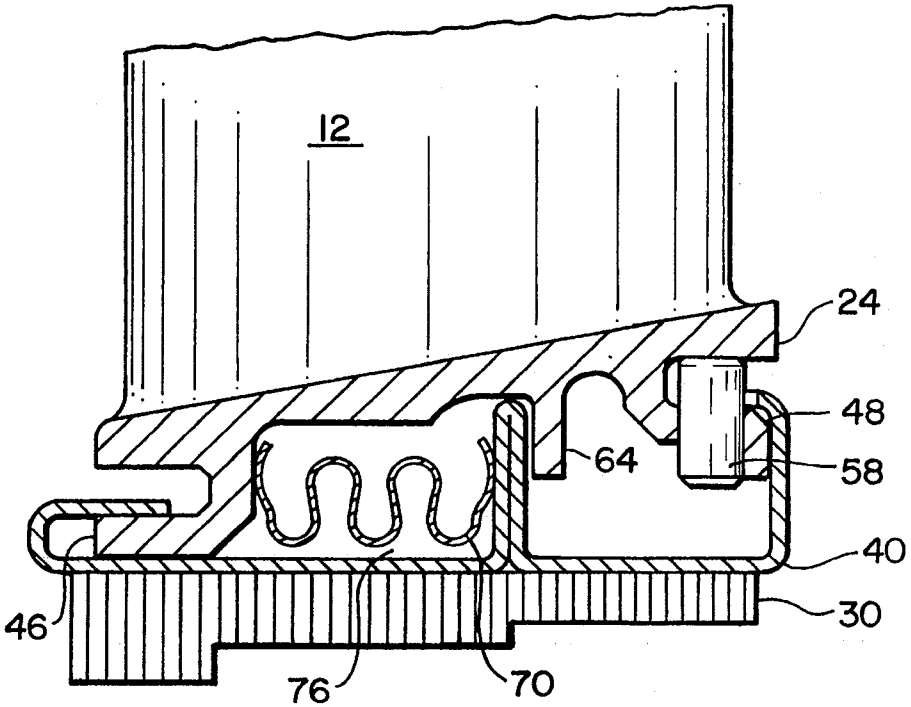
FIG. 3 is an enlarged view in section of one row of stator vanes incorporating this invention.

As best seen in FIG. 1 which is a partial view illustrating the stator section of a high pressure compressor for a gas turbine engine generally illustrated by reference numeral 10 comprising three (3) rows of vanes 12, 14, and 16 supported to the annular segmented outer shrouds 18, 20 and 22 respectively. An inner shroud 24, 26 and 28 respectfully supports the inner diameter of the vanes 12, 14 and 16, respectively. Supported to the inner diameter of the inner shrouds 24, 26 and 28 are the annular honeycomb segments 30, 32 and 34, respectively that form the labyrinth seal used to seal the fluid medium in the gas path defined between the inner shrouds 24, 26, and 28 and the outer shrouds 18, 20 and 22. A portion of the drum rotor 36 that carries the compressor rotor blades (not shown) that are rotary mounted to extend adjacent to the respective vanes and to receive the engine working medium to be compressed is shown to illustrate the teeth 38 of the labyrinth seal and how it defines with the respective honeycomb segments. As this invention is only concerned with the damper aspects of the compressor stator, for the sake of convenience and simplicity the details of the compressor and gas turbine engine are omitted herefrom. For further details reference should be made to U.S. Pat. No. 5,127,794 granted to J. C. Burge and R. J. Tiernan, Jr. on Jul. 7, 1992, entitled COMPRESSOR CASE WITH CONTROLLED THERMAL ENVIRONMENT and commonly assigned to United Technologies Corporation, the same assignee in this patent application and which is incorporated herein by reference.

As noted in FIGS. 1 and 3–5, the segmented back rings 40, 42 and 44 of the honeycomb segments serve to attach the honeycomb to the depending flanges 46 and 48, 50 and 52, and 54 and 56, respectively. Each of the segmented back rings 40, 42 and 44 are bent to define a U-shaped channel to allow the respective flanges to slide into them. Pins 58, 60 and 62, respectively, serve to secure the honeycomb elements to the inner shrouds 24, 26 and 28 in a well known manner. Depending on the particular design configuration, it is typical to include an intermediate support, such as the depending members 64, 66 and 68 to support the honeycomb as shown.

What has been described in the immediate paragraphs above is the typical and well known design for compressor stators in gas turbine engines. These component parts may be fabricated or cast. As mentioned earlier, when the parts are cast, the cast parts can not damp out the vibrations encountered. As a consequence, this vibratory energy can lead to the malfunction or destruction of the component parts of the stator.

As noted in these designs, a cavity is formed between the end flange and the depending member. This invention has been able to capitalize on this envelope and utilize this cavity, notwithstanding the fact that in actuality this area provides very little space. A judiciously shaped damper is discretely located so as to provide sufficient frictional damping to attenuate the frequencies encountered in this environment.

In accordance to this invention, dampers 70, 72 and 74 are formed from spring material into flat E-shaped segments in cross section that are fitted and compressed into cavities 76, 78 and 80 respectively. Each segment is bent into an arcuate shaped segment to define the annular shape to conform to the annular cavity formed on the inner diameter of the inner shrouds 24, 26 and 28. The end legs of the E-shaped damper bear against the inner surface of the respective flange and the vertical surface of the honeycomb ring back segment that define the cavity, and are compressed into the cavity of the stator. It is retained in that location by the respective inner shrouds and honeycomb ring segments which slide circumferentially around the stator.

As is apparent from the foregoing the E-shaped damper is relatively simple to make and is effective to work in confined spaces and hence requires a minimum of space. As noted above since it is flexible in its design, as one skilled in this art will appreciate, it has potential of being utilized for other applications. Because of its shape, the spring damper has a large load variation available which makes it efficacious in the hostile environment encountered in gas turbine engines. Of noteworthiness, is the fact that because the E-shaped damper has a large deflection capability, it overcomes the problem of tolerance accumulation usually encountered with cast compressor stators.

Figure 5:
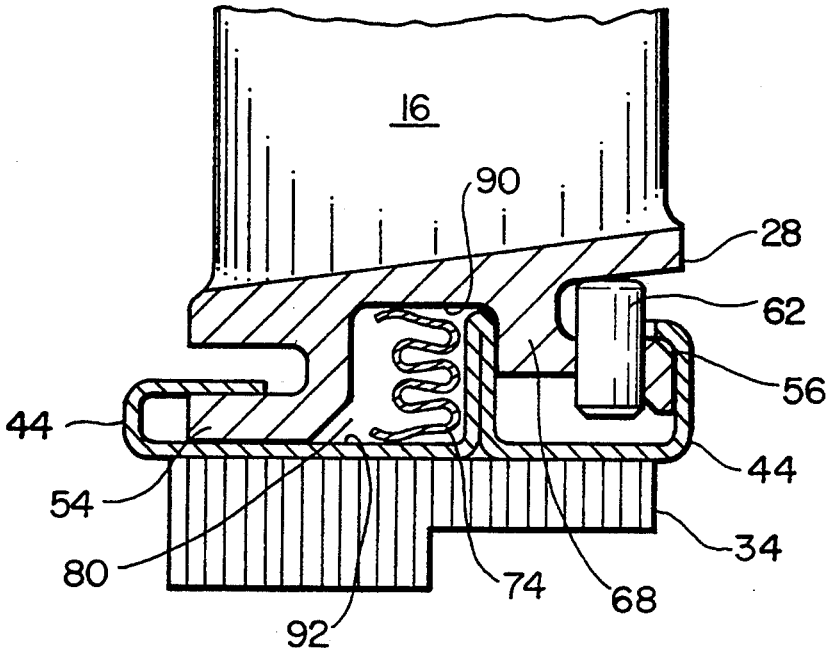
FIG. 5 is an enlarged view in section of another row of stator vanes incorporating this invention where the E-shaped Spring damper is disposed in a different orientation than the damper depicted in FIGS. 3 and 4.

FIG. 5 exemplifies how the E-shaped damper may be assembled in similar applications for compressor stators. In this configuration the "E" of the E-shaped damper is rotated 90 degrees so that the end legs of the E-shaped damper bears against the bottom surface 90 of the inner diameter of the inner shroud 28 and the outer surface 92 of the honeycomb segmented back ring 44. Identical results are obtainable in either configuration and the orientation of the E-shaped damper will depend on the particular design configuration.

Although this invention has been shown and described with respect to detailed embodiments thereof, it will be appreciated and understood by those skilled in the art that various changes in form and detail thereof may be made without departing from the spirit and scope of the claimed invention.

We claim:

1. In combination, a stator for rotating machinery which includes integrally cast stator vanes and shrouds, the inner shroud of said shrouds being disposed adjacent to the inner diameter of said vanes and defining an annular surface, a segmented honeycomb seal element concentrically supported to the shroud and defining with said annular surface an annular cavity, a mechanical damper being E-shaped in cross-section fabricated from flexible, resilient spring material adaptable to form an annular shape to fit within said cavity and bear against the surface of said inner shroud in frictional relationship to dissipate energy of the vibratory motion imparted to said stator.

2. The combination as claimed in claim 1 wherein said shroud is disposed in the compressor of a gas turbine engine and said compressor includes a drum rotor having radially extending teeth that engage the honeycomb of said honecomb segments to form a seal to prevent leakage of the working fluid medium of said gas turbine engine.

3. The combination as claimed in claim 2 including segmented back rings supporting said honeycomb segments and means to support said honeycomb segments to said stator.

4. The combination as claimed in claim 3 wherein said means includes axially extending flanges disposed on opposite sides of the inner diameter of said inner shroud and said segmented back rings including complementary U-shaped side portions defining annular channels to accommodate each of said axially extending flanges.

5. The combination as claimed in claim 4 wherein the E-shaped damper includes end legs, one of said end legs bearing against the inner surface of the inner diameter of said inner shroud and the other of said end legs bearing against the outer surface of said segmented back ring.

6. The combination of claim 4 including a pair of spaced radial depending walls defining said cavity in the inner diameter of said inner shroud, said E-shaped damper includes a pair of end legs, one of said end legs bearing against at least one of said pair of radial depending walls.

7. The combination of claim 6 wherein said segmented back ring includes a radial extending portion bearing against one of said radial depending walls, and the other of said end legs bears against said radial extending portion.

8. The combination of claim 1 wherein said E-shaped damper is segmented.

* * * * *